US006167653B1

(12) United States Patent
Van den Kieboom

(10) Patent No.: US 6,167,653 B1
(45) Date of Patent: Jan. 2, 2001

(54) COMBINATION FLORAL PRODUCT AND DISPLAY CONTAINER IMPRINTED WRAP AROUND MESSAGE SLEEVE ON FLORAL PRODUCT AND DISPLAY CONTAINER

(76) Inventor: Jan M. Van den Kieboom, 9023 Glenwood Dr., Greendale, WI (US) 53129

( * ) Notice: Under 35 U.S.C. 154(b), the term of this patent shall be extended for 0 days.

(21) Appl. No.: 09/337,424

(22) Filed: Jun. 21, 1999

Related U.S. Application Data

(60) Provisional application No. 60/090,208, filed on Jun. 22, 1998.

(51) Int. Cl.[7] ..... B65D 85/52
(52) U.S. Cl. ..... 47/84; 47/72; 208/423
(58) Field of Search ..... 47/84, 87, 72, 47/65; 206/423

(56) References Cited

U.S. PATENT DOCUMENTS

| | | | | |
|---|---|---|---|---|
| 786,547 | * | 4/1905 | Chamberlin | 47/84 X |
| 2,767,831 | * | 3/1956 | Brecht | 206/423 |
| 3,144,932 | * | 8/1964 | Zerbo, Jr. . | |
| 4,118,890 | * | 10/1978 | Shore | 47/84 X |
| 4,662,107 | * | 5/1987 | Van Den Kieboom | 47/72 X |
| 4,863,015 | * | 9/1989 | Toltzman | 206/423 X |
| 4,936,046 | * | 6/1990 | Miller | 47/84 X |
| 4,941,572 | * | 7/1990 | Harris | 206/423 |
| 5,293,715 | * | 3/1994 | Kaz | 206/423 X |
| 6,061,955 | * | 5/2000 | Domstein | 47/84 X |

FOREIGN PATENT DOCUMENTS

| | | | |
|---|---|---|---|
| 3514514 | * | 10/1986 | (DE) . |
| 2658798 | * | 8/1991 | (FR) . |

* cited by examiner

*Primary Examiner*—Michael J. Carone
*Assistant Examiner*—Jeffrey L. Gellner
(74) *Attorney, Agent, or Firm*—Andrus, Sceales, Starke & Sawall, LLP

(57) ABSTRACT

A rigid, hollow, bottomless container for transporting and displaying a seed ball which includes a sleeve extending about the container that allows printed indicia to be located on the exterior of the container. The container is comprised of a number of side walls integrally or separately formed and connected to form the container. Each side wall contains an upper and lower ridge on opposite ends of a central panel which define a channel extending around the exterior of the container. The sleeve is formed of a resilient material and is positioned about the container within the channel and allows an individual to display printed material on the exterior of the container, by printing directly on the sleeve, or by placing preprinted cards between the sleeve and the side wall that rest on the lower ridge of the side walls of the container. The container is able to contain a seed ball without the need for a bottom surface due to the frictional forces generated by a bag enclosing the seed ball and the interior surfaces of the passage extending through the container.

12 Claims, 1 Drawing Sheet

COMBINATION FLORAL PRODUCT AND DISPLAY CONTAINER IMPRINTED WRAP AROUND MESSAGE SLEEVE ON FLORAL PRODUCT AND DISPLAY CONTAINER

CROSS-REFERENCE TO RELATED APPLICATIONS

This application is based on and claims priority from Provisional Application Serial No. 60/090,208 filed Jun. 22, 1998.

FIELD OF THE INVENTION

The present invention is directed to a combination shipping and display container for various types of plants, including flowering plants, and more specifically is directed to an inexpensive, hollow, bottomless container used to ship and display seed balls containing plants of the above-mentioned types formed of an elongate strip of a printable material.

BACKGROUND OF THE INVENTION

As flowers and plants are often sent to individuals for various reasons, such as birthdays and anniversaries, it is necessary to place the plants within a container that protects the plants during shipment. In many cases, the plant to be shipped includes a seed ball. The seed ball is formed of an amount of soil bound about the roots of the plant by a breathable material, such as a piece of burlap. The seed ball enables the plant to survive the time period during which the plant is in transit.

In order to protect the seed ball during shipment, the seed ball is positioned within a container suitable for enclosing and preventing damage to the seed ball. Normally, these containers take the form of rigid flower pots that are used to display the plant after delivery as well as to protect the plant during shipment. However, due to the weight of a flower pot, containers of this type significantly increase the overall weight of the plant to be shipped. This increases the cost of shipping the plants to a point where the cost of sending a plant to someone becomes undesirably expensive.

Therefore, it is desirable to develop a container for the shipment of a plant including a seed ball that is lightweight, but able to protect the seed ball during shipment, and that also may be used as an attractive display container for the plant after the delivery of the plant.

SUMMARY OF THE INVENTION

It is an object of the invention to provide a hollow, bottomless shipping and display container which is capable of displaying printed material on the container in the form of a pre-printed sleeve positioned about the exterior of the container, or preprinted cards inserted between the sleeve and the exterior of the container.

It is a further object of the present invention to provide a hollow, bottomless shipping and display container for a seed ball that is lightweight in order to reduce the costs of shipping a seed ball using the container.

It is still further object of the invention to provide a hollow, bottomless shipping and display container for a seed ball that is inexpensive to manufacture.

A hollow, bottomless shipping and display container for seed balls includes a number of side walls connected to one another and defining a passage extending through the container into which the seed ball is placed. Each side wall includes a pair of ridges outwardly extending from the top and bottom edges of each side wall that define a rectangular channel extending along the exterior of each side wall of the container.

A sleeve formed of a resilient, printable material is positioned within the channel along each side wall. The sleeve is formed of an elongate, rectangular strip that includes a number of wall sections and a closure tab at one end. The wall sections and tab are separated by fold lines extending across the strip perpendicular to the sections. The dimensions of each wall section generally correspond to the dimensions of the channel extending around the container such that, when the sleeve is positioned on the container, the closure tab overlaps the wall section opposite the tab on the sleeve, retaining the sleeve on the container. The sleeve also rests on the lower ridge of each side wall, allowing an individual to place preprinted cards, such as business cards, in the space between the sleeve and the side wall.

The container does not require a bottom surface as the seed ball is compressed within the passage by the side walls, creating frictional forces between the container and seed ball sufficient to hold the seed ball within the container. During shipment, the container and seed ball are wrapped in a water resistant enclosure and placed within a box dimensioned to conform to the shape of the exterior. When the container is used to display the plant contained within the seed ball, the bag forming the exterior of the seed ball extends outwardly over and frictionally contacts the edge of each side wall. These frictional forces cooperate with the frictional forces between the side walls and the seed ball to retain the seed ball within the container when the container is used to display the plants.

DETAILED DESCRIPTION OF THE INVENTION

Figure 1:
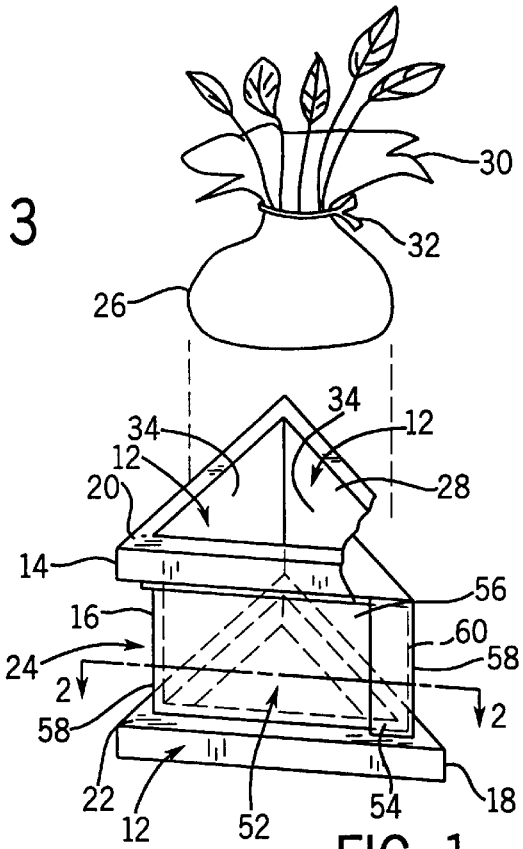
FIG. 1 is an exploded view of a container constructed according to the present invention and a seed ball to be placed within the container.
Figure 2:
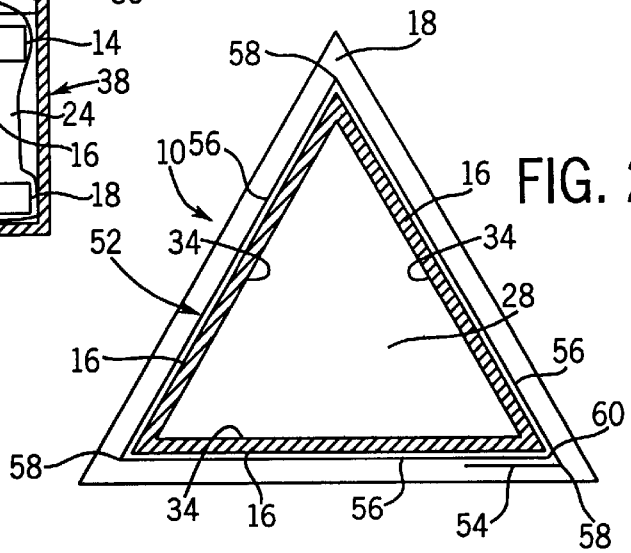
FIG. 2 is a cross-sectional view along line 2—2 of FIG. 1.

With reference now to the drawing figures in which like reference numerals designate like parts throughout the disclosure, a hollow, bottomless shipping and display container indicated generally at 10 is illustrated in FIGS. 1 and 2. The container 10, is used to hold a seed ball 26 and is generally triangular in shape, and includes three side walls 12 extending along each side of the container. Each side wall 12 includes an outwardly extending top section 14, a central panel section 16, and an outwardly extending lower section 18 formed similarly to top section 14. The container 10 can be formed such that side walls 12 are integrally formed with one another from a rigid thermoplastic material, as shown in FIG. 1, or each side wall 12 may be formed separately from a rigid material, such as wood, and later interconnected with other side walls utilizing a suitable securing means, such as an adhesive.

The top section 14 and bottom section 18 on each side wall 12 join to form a top ridge 20 and a bottom ridge 22 extending around the periphery of the container 10. The ridges 20 and 22 also define a channel 24 therebetween with panel section 16 forming the base of the channel 24. As the container 10 formed by the side walls 12 does not have a top or bottom surface, the container defines a passage 28 between the side walls extending completely through the container.

The seed ball 26 inserted into the container 10 includes a number of plants and an amount of soil held within a bag 30. The bag 30 is secured about the soil and a portion of the plant by a strap 32 secured around the bag 30 above the soil. When the seed ball 26 is positioned within the passage 28 of container 10, the bag 30 frictionally contacts the interior surfaces 34 of each side wall 12 defining the passage 28. The frictional forces generated by this contact serve to retain the seed bulb 26 within the container 10.

Figure 4:
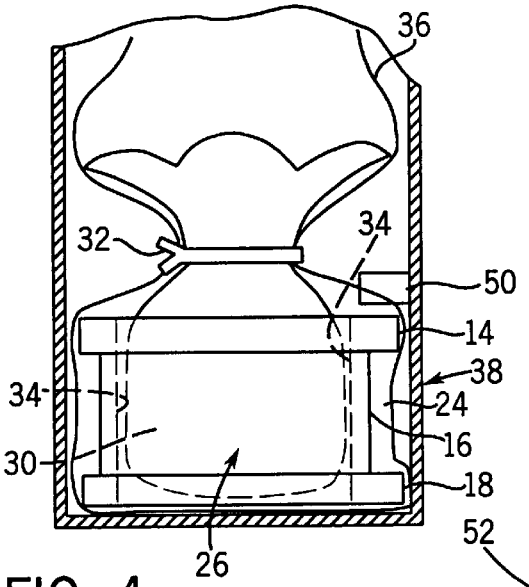
FIG. 4 is a cross-sectional view of the arrangement of FIG. 3.

After securely positioning the seed ball 26 within the container 10, a second water-proof bag 36 may be wrapped about the seed ball 26 and container 10 in an arrangement as shown in FIG. 4. This second bag 36 serves to prevent leakage of fluid from the seed ball 26 and damage to the container 10 during shipment of the seed ball and container arrangement.

Figure 3:
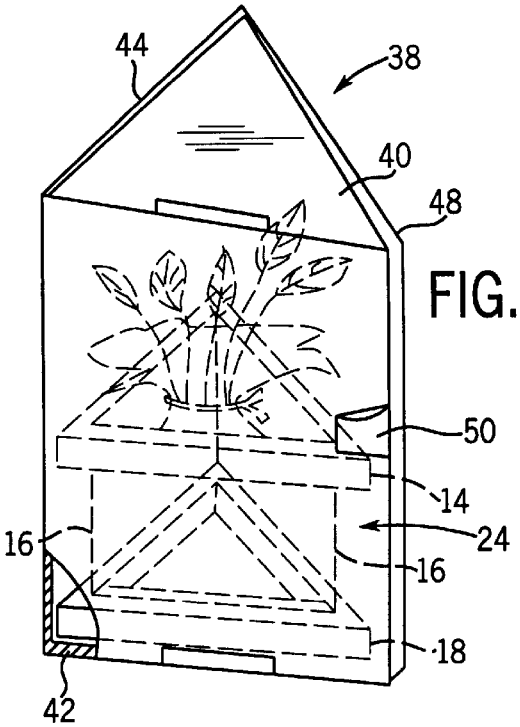
FIG. 3 is a partially broken away view of the arrangement of the container and seed ball of FIG. 1 positioned within a shipping box.

After being secured within the second bag, the seed ball and container arrangement may be positioned within a specialized shipping box 38, as shown in FIGS. 3 and 4. The box 38 is shaped similarly to the container 10, and includes a triangular top wall 40, a triangular bottom wall 42, and a pair of rectangular side walls 44 and 46 secured between two sides of the top and bottom walls 40 and 42. The box 38 also includes a pivotable side wall 48 attached at one end to the stationary side wall 44. Opposite wall 44, pivotable wall 48 includes a tongue 50 extending outwardly from pivotable wall 48. The tongue 50 is engageable with a slot (not shown) disposed in the stationary side wall 46 to secure the movable wall 48 in a closed position about the seed ball and container arrangement.

Looking now at FIGS. 1 and 2, the container 10 also includes a sleeve 52 formed of a resilient material which is positioned within the channel 24 extending about the container 10. The sleeve 52 is formed of a single strip of the resilient material and includes a closure tab 54 at one end and three wall sections 56 extending from the closure tab 54 along the remainder of the strip. The strip also includes a number of fold lines 58 located between each of the closure tab 54 and the wall sections 56. The fold lines 58 enable the sleeve 52 to be creased into a shape corresponding to the shape of the container 10, with the closure tab 54 overlapping the end 60 of the wall section 56 opposite the tab. After creasing the sleeve 52 along the fold lines 58, the sleeve 52 may be positioned about the container 10 by positioning individual wall sections 56 within the sections of the channel 24 defined on each side wall 12 of the container 10. The closure tab 54 is then placed over the end 60 of the opposite wall section 56 to reliably secure the sleeve 52 onto the container 10.

As the sleeve 52 is formed of a printable material, the sleeve 52 may include printed matter on the exterior surfaces of the wall sections 56. The sleeve 52 may also function to retain preprinted cards (not shown) on the container 12. The cards are inserted into the space between the wall sections 56 and the side walls 12 in the channel 24 on container 10, so that the cards rest on the bottom ridge 22 formed by each side wall 12. As the sleeve 52 is formed of a resilient material, the material may be clear plastic so that unimpeded viewing of the printed material on the card is achieved.

I claim:

1. In combination, a seed ball including a bag containing an amount of soil and a plant;

a hollow, bottomless container defining a passage into which the seed ball is placed, the container including a number of interconnected side walls, each side wall having a top edge, a bottom edge, and a first ridge protruding outwardly from the bottom edge of the side wall; and a sleeve formed of a resilient material removably positioned about the exterior of the container and resting on the first ridge.

2. The combination of claim 1 wherein the container further comprises a second ridge extending from the top edges of the side walls and defining a channel between the first and second ridges about the container in which the sleeve is positioned.

3. The combination of claim 2 wherein the side walls are integrally formed with each other.

4. The combination of claim 2 wherein the side walls are formed separately from one another and are connected by a securing means at each end.

5. The combination of claim 4 wherein the securing means is an adhesive.

6. The combination of claim 5 wherein the container is generally triangular in shape.

7. The combination of claim 2 wherein the sleeve is an elongate, rectangular strip including a closure tab at one end and a number of side wall sections extending along the length of the strip, the wall sections and closure tab being separated by fold lines extending across the strip that allow the tab and wall sections to flex with respect to adjacent sections in order to position the sleeve along the side walls of the container such that the closure tab engages the wall section opposite the closure tab to secure the sleeve about the container.

8. The combination of claim 7 wherein the sleeve is formed of a thermoplastic material.

9. The combination of claim 8 wherein the sleeve further includes printed material on the wall sections of the sleeve.

10. The combination of claim 8 wherein the sleeve is at least partially clear.

11. The combination of claim 10 further comprising printed cards positioned between the side wall of the container and the wall sections of the sleeve, the cards resting on the lower ridge of the container.

12. The combination of claim 8 wherein the tab is secured to the wall section opposite the tab by an adhesive.

* * * * *